United States Patent [19]

Asbury, Jr. et al.

[11] Patent Number: 5,029,768

[45] **Date of Patent: * Jul. 9, 1991**

[54] TAPE DISPENSER

[75] Inventors: Charles E. Asbury, Jr., Vancouver, Wash.; Boris Boltak, Portland, Oreg.; Victor H. Clausen, Vancouver, Wash.

[73] Assignee: H.B. Fuller Company, Vancouver, Wash.

[ * ] Notice: The portion of the term of this patent subsequent to Apr. 17, 2007 has been disclaimed.

[21] Appl. No.: 487,651

[22] Filed: Mar. 2, 1990

Related U.S. Application Data

[62] Division of Ser. No. 241,418, Sep. 7, 1988.

[51] Int. Cl.[5] ..... B65H 19/18

[52] U.S. Cl. ..... 242/58.1; 242/58.4

[58] Field of Search ..... 242/58.1, 58.2, 58.3, 242/58.4, 58.5, 58.6

[56] References Cited

U.S. PATENT DOCUMENTS

| | | | |
|---|---|---|---|
| 2,651,474 | 9/1953 | Van Dusen | 242/75 |
| 2,724,426 | 11/1955 | Bell et al. | 154/42 |
| 2,974,839 | 3/1961 | Batlas et al. | 225/12 |
| 3,089,665 | 3/1963 | Gardner, Jr. | 242/156 |
| 3,482,800 | 12/1969 | Barnett et al. | 242/192 |
| 3,559,909 | 2/1971 | Whiteman et al. | 242/56.1 |
| 3,625,446 | 12/1971 | Floyd | 242/67.3 R |
| 3,730,811 | 5/1973 | Wendt | 156/367 |
| 3,731,889 | 5/1973 | Alexeff | 242/156.2 |
| 3,915,264 | 10/1975 | Ohi | 188/75 |
| 4,612,080 | 9/1986 | Aiuola et al. | 156/504 |
| 4,617,716 | 10/1986 | Lay et al. | 29/526 R |

FOREIGN PATENT DOCUMENTS

| | | |
|---|---|---|
| 230593 | 3/1959 | Australia . |
| 2185241A | 10/1986 | United Kingdom . |

*Primary Examiner*—Daniel P. Stodola
*Assistant Examiner*—John P. Darling
*Attorney, Agent, or Firm*—Klarquist, Sparkman, Campbell, Leigh & Whinston

[57] ABSTRACT

A tape dispenser includes an automatic tension control mechanism and provision for auto-splicing the tail portion of one tape to the leading portion of another.

7 Claims, 9 Drawing Sheets

TAPE DISPENSER

RELATED APPLICATION DATA

This application is a divisional of copending application Ser. No. 07/241,418, filed Sept. 7, 1988.

FIELD OF THE INVENTION

The present invention relates to automatic tape dispensing systems, and more particularly to apparatuses for splicing and tensioning tapes in such systems.

BACKGROUND AND SUMMARY OF THE INVENTION

Modern consumer and industrial packaging often includes reinforcing tapes or tear tapes as part of their construction. Various tape dispensers have been devised to dispense such tapes into corrugator and packaging equipment. However, all have certain drawbacks.

One of the principal drawbacks of the prior art systems is in their techniques for changing from one spool of tape to another when the first spool becomes depleted. Many systems require that the packaging line be halted while a new spool of tape is installed and threaded through the appropriate tape guides. This interruption is intolerable in complex packaging lines which rely, for their cost effectiveness, on continuous, uninterrupted operation.

To partially alleviate the interruption problem, some tape dispensing systems rely on a human operator to stand at the ready and manually splice the tapes together. The operator loops the leading end of a replacement spool of tape about the free running tape on the first spool. When the first spool is nearly depleted, the corrugator or packaging equipment is slowed to about one third of its normal speed and the operator cinches the loop onto the free running tape to form a splice knot. At the same instant he manually spins the second spool to overcome its static inertia so that the machine can draw tape therefrom.

This approach, although an improvement, has several problems. One is that it requires a skilled operator to monitor the tape spools and be ready to tie the splicing knot at the critical instant. Another problem is that it requires the packaging equipment be slowed from its usual speed. Still another problem is that, even if the splice is successfully made (and often it is not), the operator's manual acceleration of the second spool may not be sufficient to prevent the tape from breaking when the packaging line suddenly starts pulling several hundred of feet of tape per minute from the spool. A tape break, of course, requires that the packaging line be stopped, the very problem that was sought to be avoided. Yet another problem is that some slack may be momentarily introduced into the second tape by the operator's manual spinning of the spool. This slack permits the tape to change its orientation and may result, for example, in an adhesive tape being applied to the packaging wrong side down.

Accordingly, a need remains for an improved technique for splicing from one spool of tape to another in an automatic packaging line so that the packaging line can reliably operate without interruption.

A further need remains for an improved system for controlling the tension and orientation of the tapes during a splicing operation so that the spliced tape is not broken nor applied with the wrong orientation.

It is the object of the present invention to fulfill these and other needs.

According to one embodiment of the present invention, a spool of tape is provided with end elements that cooperate with end elements on the next spool of tape to make the tapes self splicing. One tape, for example, can be provided near its trailing end with a pin extending thereacross. The second tape can be provided at its leading end with a loop sized so that the pin cannot pass therethrough. When the pin engages the loop, the tapes become linked, causing the trailing end of the first tape to pull the leading end of the second tape into the packaging equipment.

The foregoing and additional objects, features and advantages of the present invention will be more readily apparent from the following detailed description, which proceeds with reference to the accompanying drawings.

DETAILED DESCRIPTION

Figure 1:
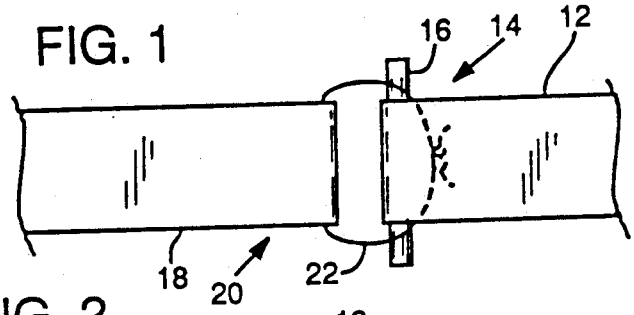
FIG. 1 is an illustration showing the splice formed by cooperation between a pin on the trailing end of a first tape with a loop on the leading end of a second tape.

Referring first to FIG. 1, each tape is provided with end elements which cooperate with end elements on other tapes to make the tapes self-splicing. In FIG. 1, a first tape 12 is provided at its trailing end 14 with a pin end element 16. A second tape 18 is provided at its leading end 20 with a loop element 22. When the pin 16 engages the loop 22, the tapes become linked, causing the trailing end of the first tape to pull the leading end of the second tape into the machine.

Figure 2:
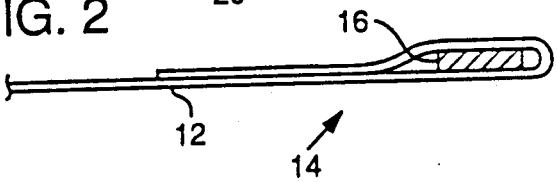
FIG. 2 is an illustration showing how the pin component is affixed to the tape end.

End elements 16 and 22 can be attached to the tapes in a variety of ways. Illustrated in FIG. 2 is a technique applicable with adhesive tapes, such as hot melt tapes, wherein the end element (here a pin 16) is placed on the tape and the tape looped back and adhered to itself. The loop element is affixed similarly.

Figure 3:
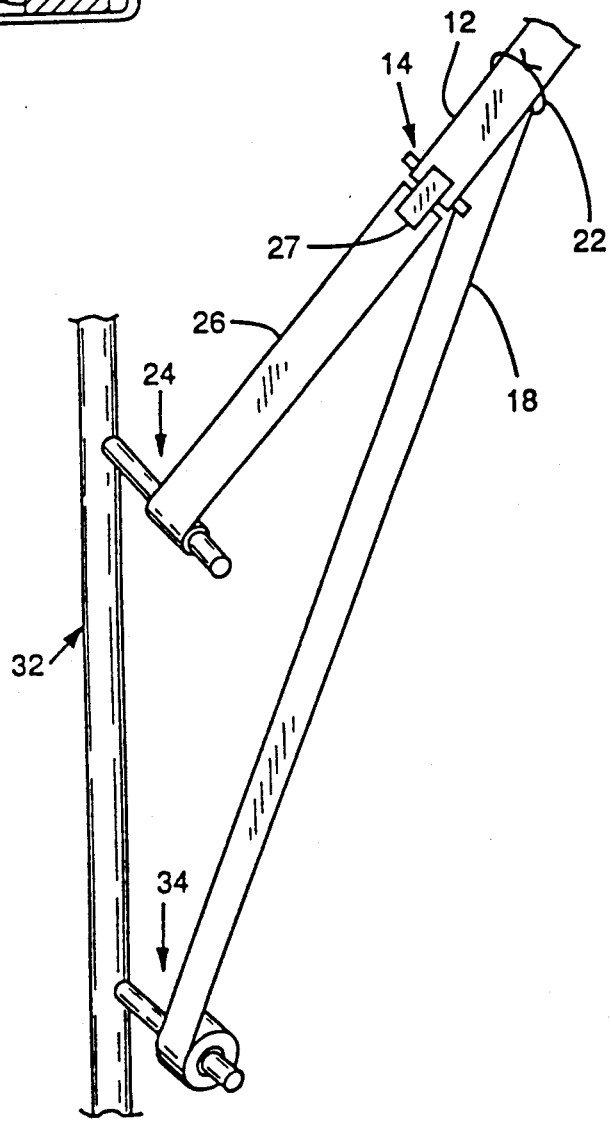
FIG. 3 is an illustration showing a detachable tail on the trailing end of the first tape to maintain proper orientation of the splice.
Figure 4:
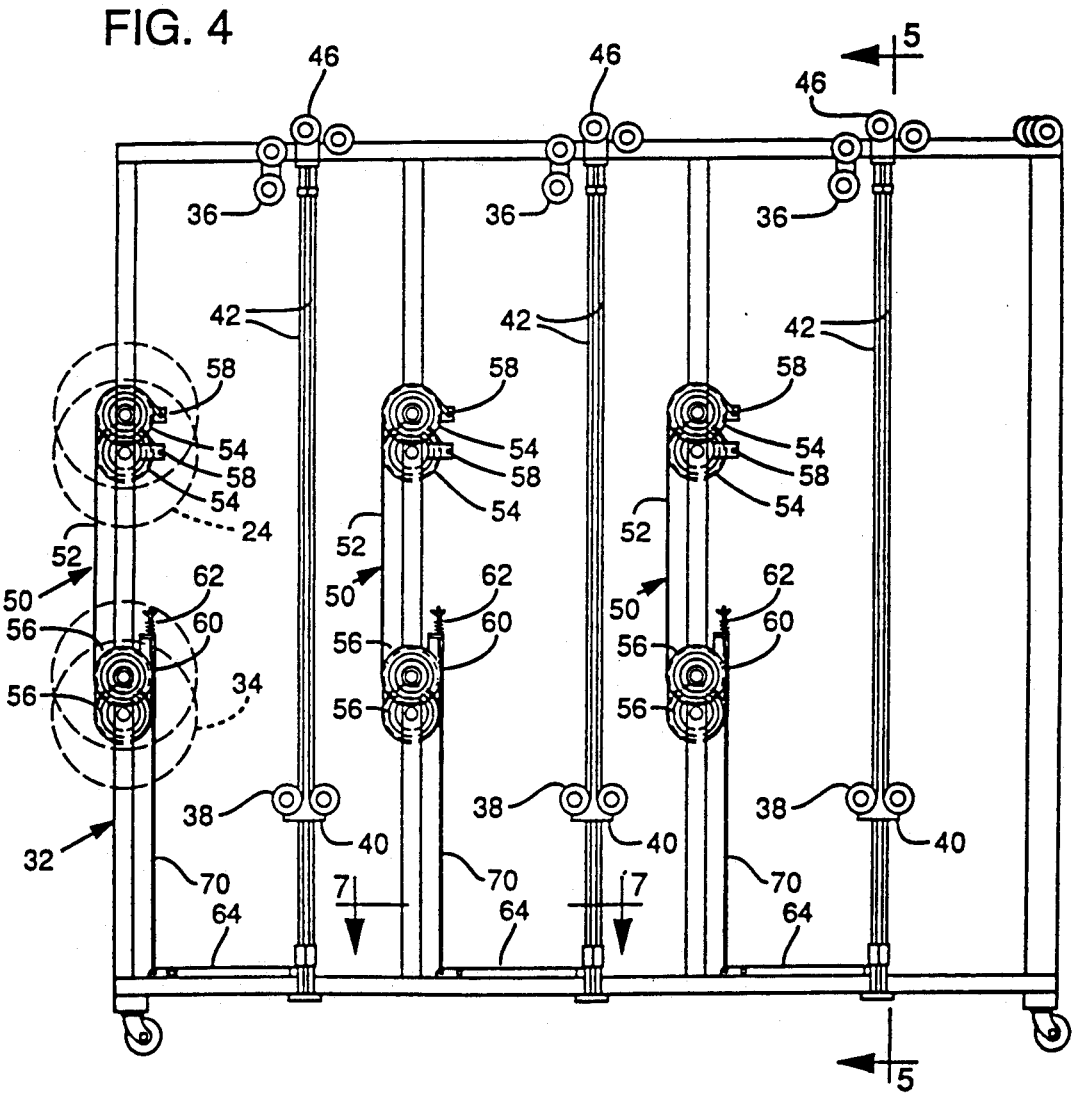
FIG. 4 is a front view of a tape dispensing apparatus employing the tension control system of the present invention.
Figure 6:
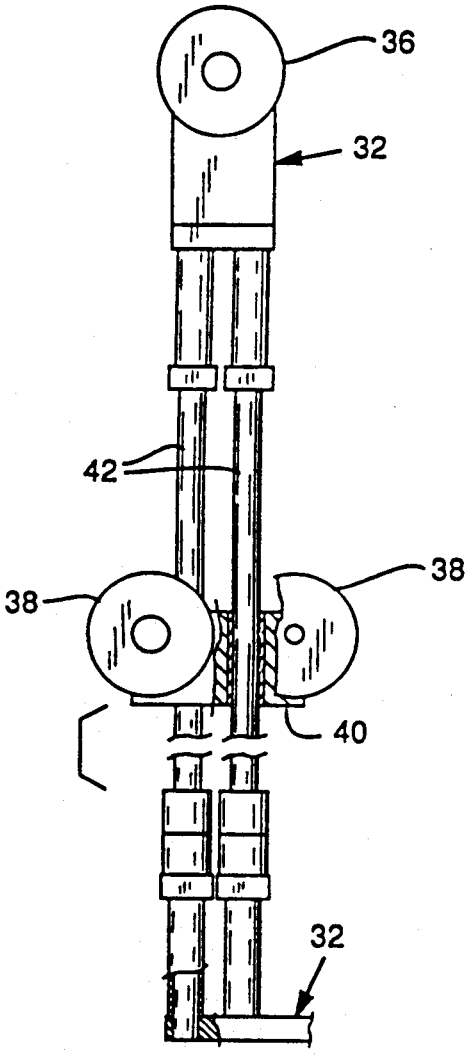
FIG. 6 is a view taken on line 6—6 of FIG. 5.
Figure 5:
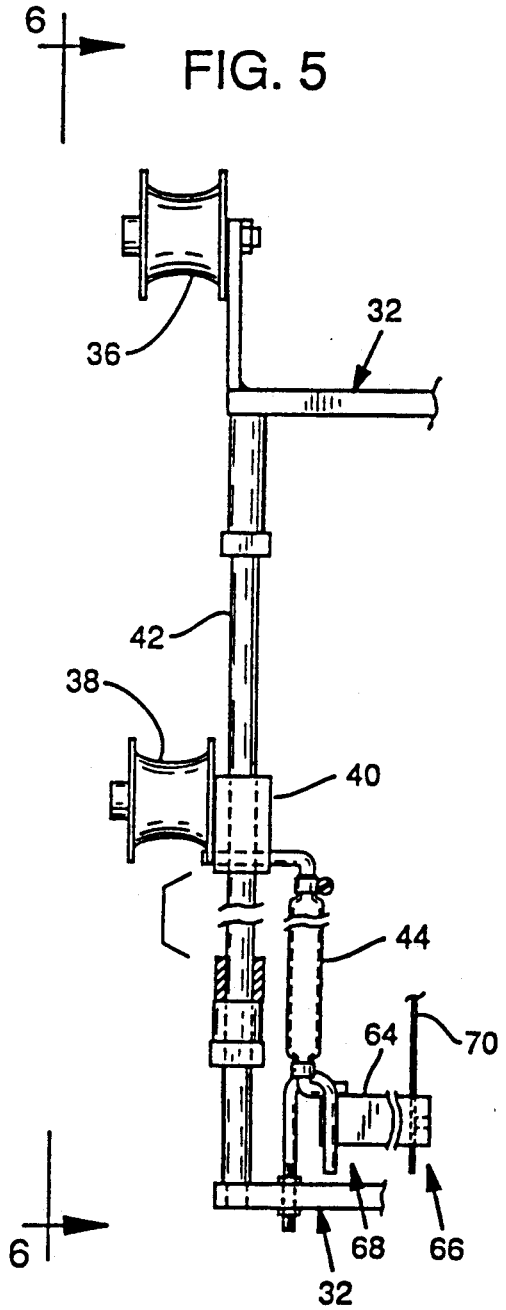
FIG. 5 is a section taken on line 5—5 of FIG. 4.
Figure 7:
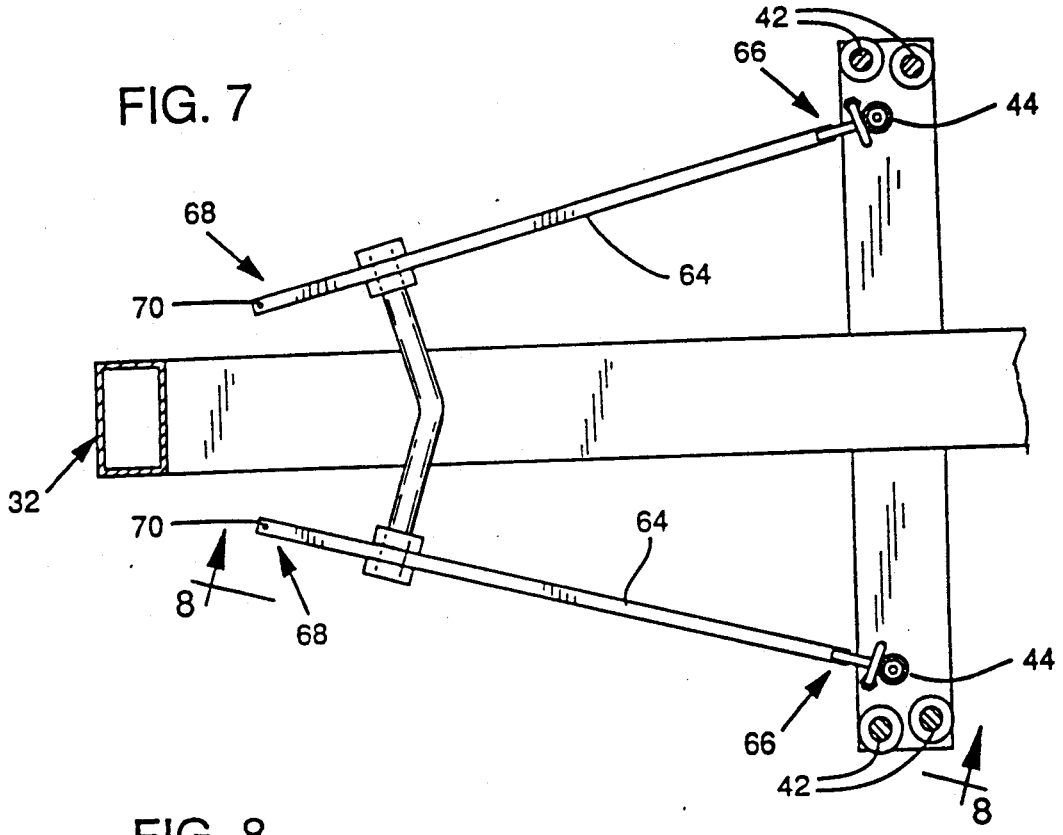
FIG. 7 is a section taken on line 7—7 of FIG. 4.
Figure 8:
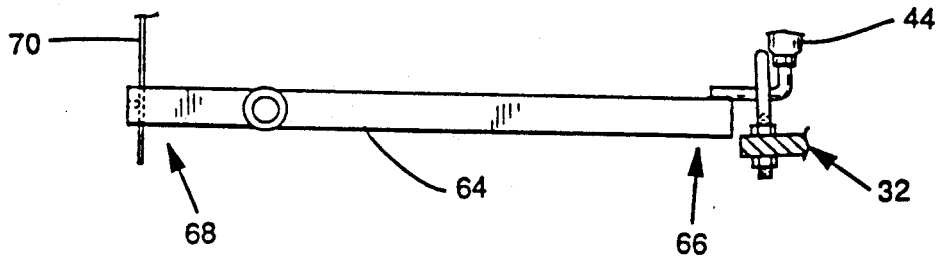
FIG. 8 is a view taken on line 8—8 of FIG. 7.
Figure 9A:
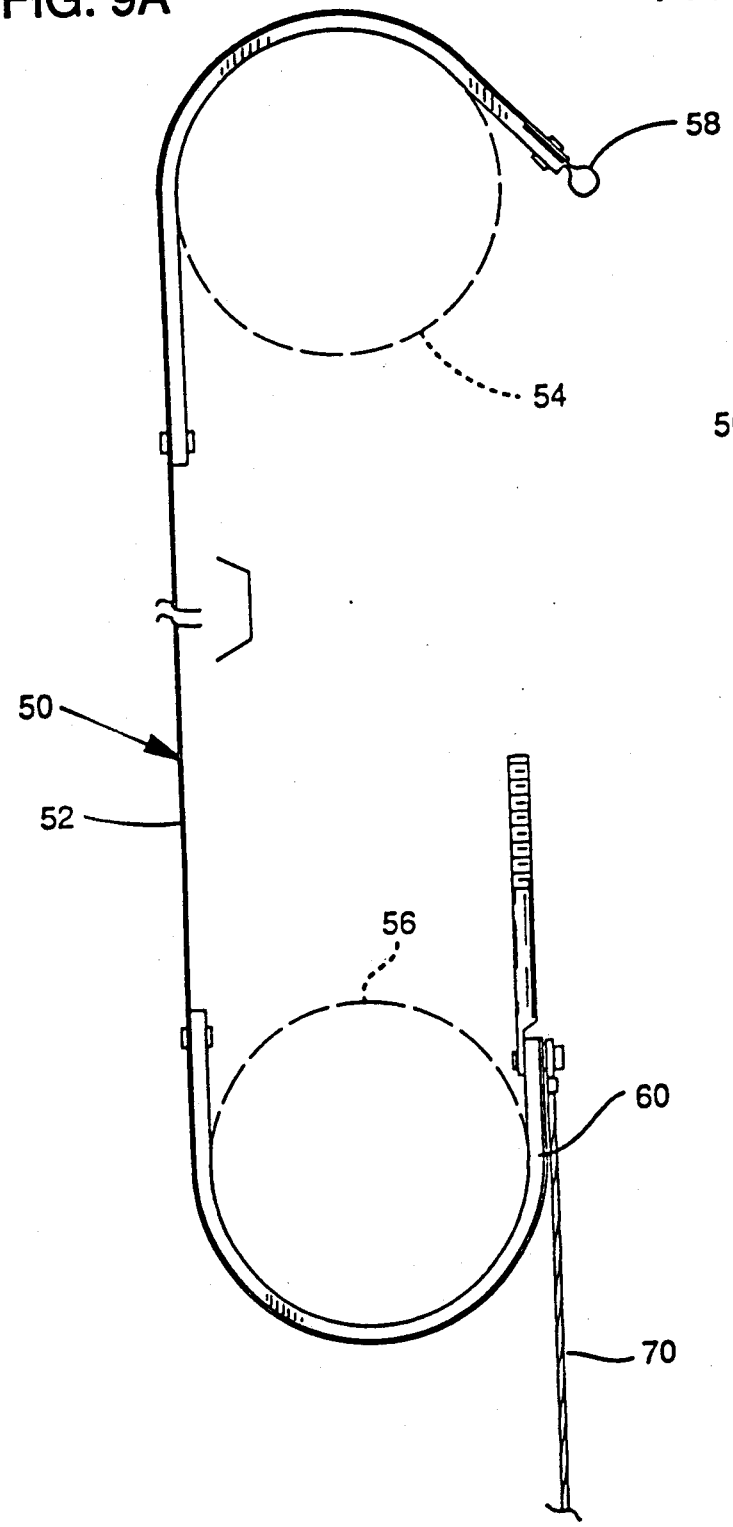
FIG. 9 shows a brake band assembly used with the tension control system of FIG. 4.
Figure 9B:
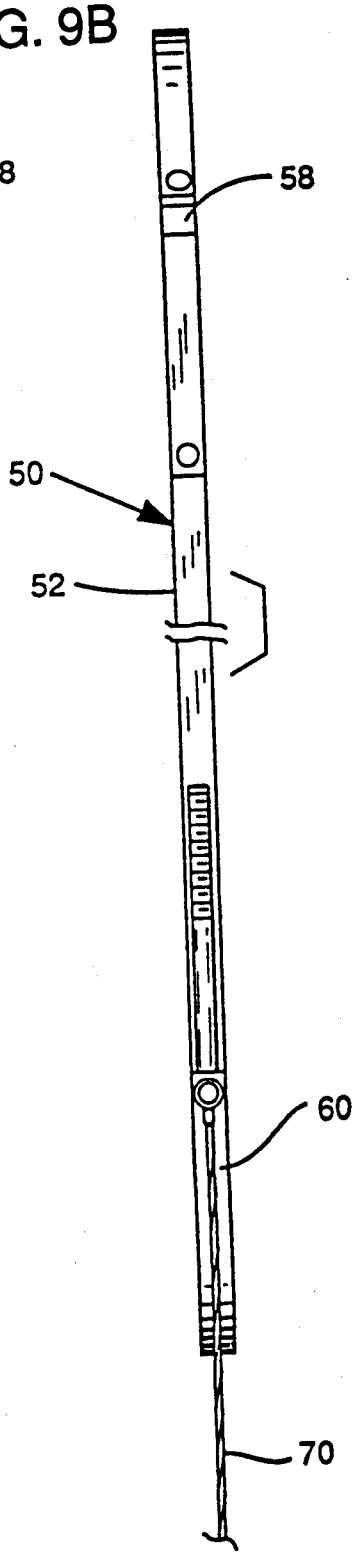
Figure 10A:
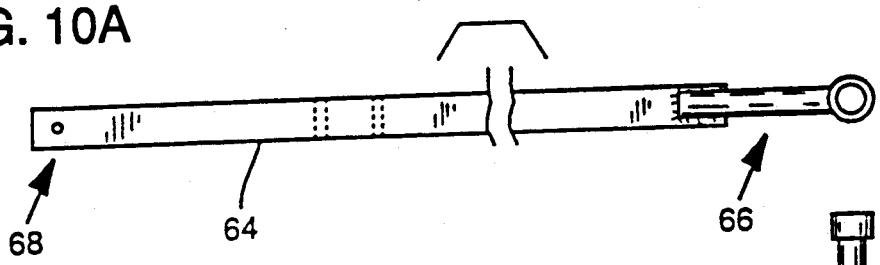
FIG. 10 shows a lever used with the tension control system of FIG. 4.
Figure 10B:
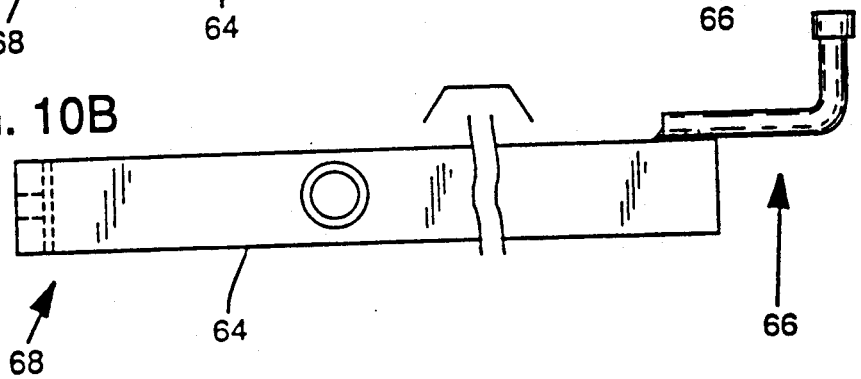
Figure 11A:
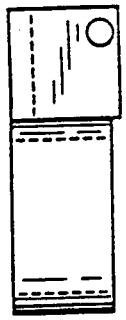
FIG. 11 shows a brake band bracket used with the tension control system of FIG. 4.
Figure 11B:
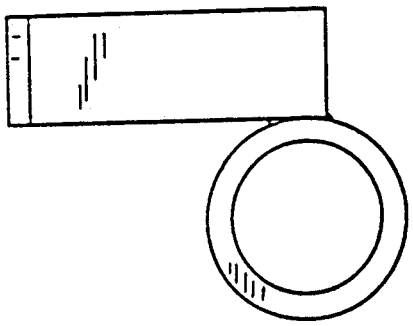

FIG. 3 shows the relationship of the two tapes just before the first spool of tape 24 becomes depleted. It will be recognized that some means must be provided for positioning loop 22 around the first tape 12. In the illustrated embodiment, this is achieved by forming end element 16 of reinforced string and tying it in a loop around the first tape. Other techniques could, of course, be used.

When the trailing end 14 of tape 12 comes off spool 24, it would normally be free to twist and turn. Such movement, however, may result in the tape being introduced into the machine wrong side down. The second tape that followed it would likewise be misoriented. To avoid this problem, the trailing end of the first tape 12 is desirably provided with a tail segment 26 affixed to the spool. The tail segment 26 has a length sufficient so that the second tape is linked to the trailing end of the first tape, in the proper orientation, before the end of the tail segment is reached.

In the embodiment shown in FIG. 3, the tail segment 26 is detachably connected to the trailing end of the first tape 12 by means such as masking tape 27. The other end of the tail segment is securely affixed to the spool 24. When the first tape draws the tail segment tight, the masking tape joint is pulled free, leaving the tail segment dangling from the spool and leaving the pin/loop splice free to travel into the machine.

In other embodiments, the tail segment need not be detachable as shown. Instead, it can be securely affixed to the first tape and not connected to the spool. When the end of the tail segment comes free of the spool, it is introduced into the machine and applied just as with any other tape.

Figure 12:
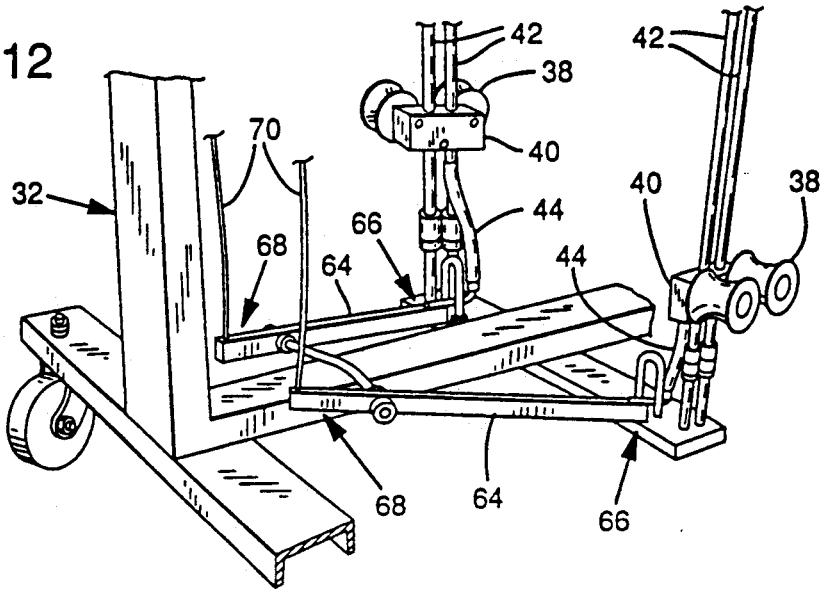
FIG. 12 is a view showing portion of the tension control system of FIG. 4.
Figure 13:
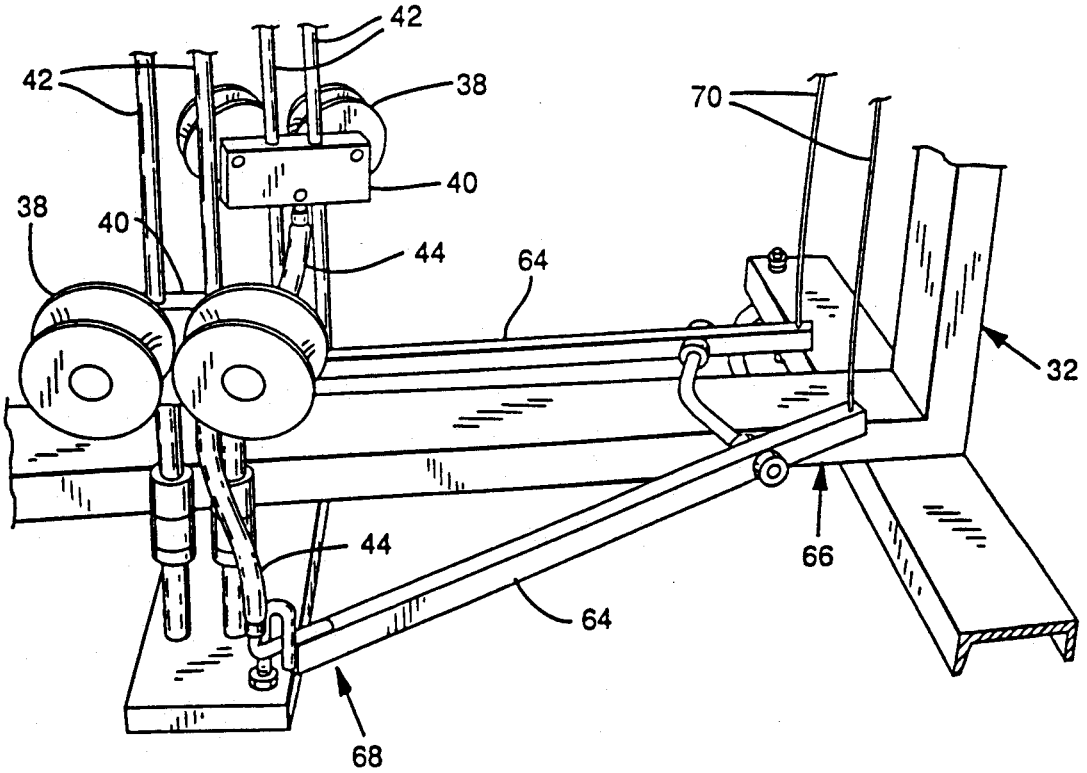
FIG. 13 is a view showing another portion of the tension control system of FIG. 4.
Figure 14:
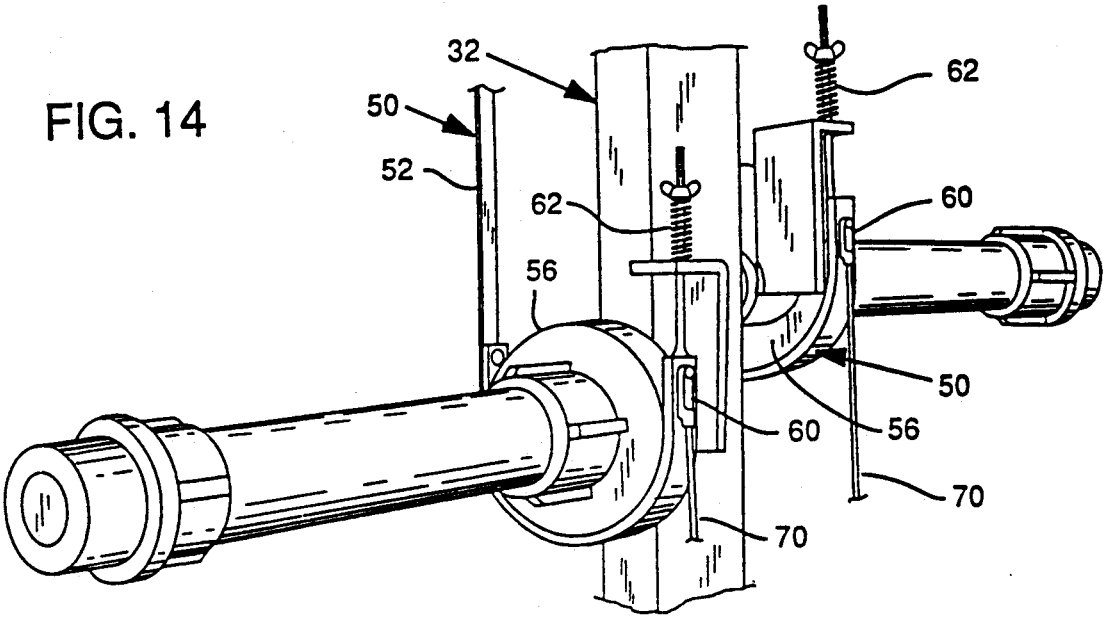
FIG. 14 is a view showing the brake band and the spindles in the tension control system of FIG. 4.
Figure 15:
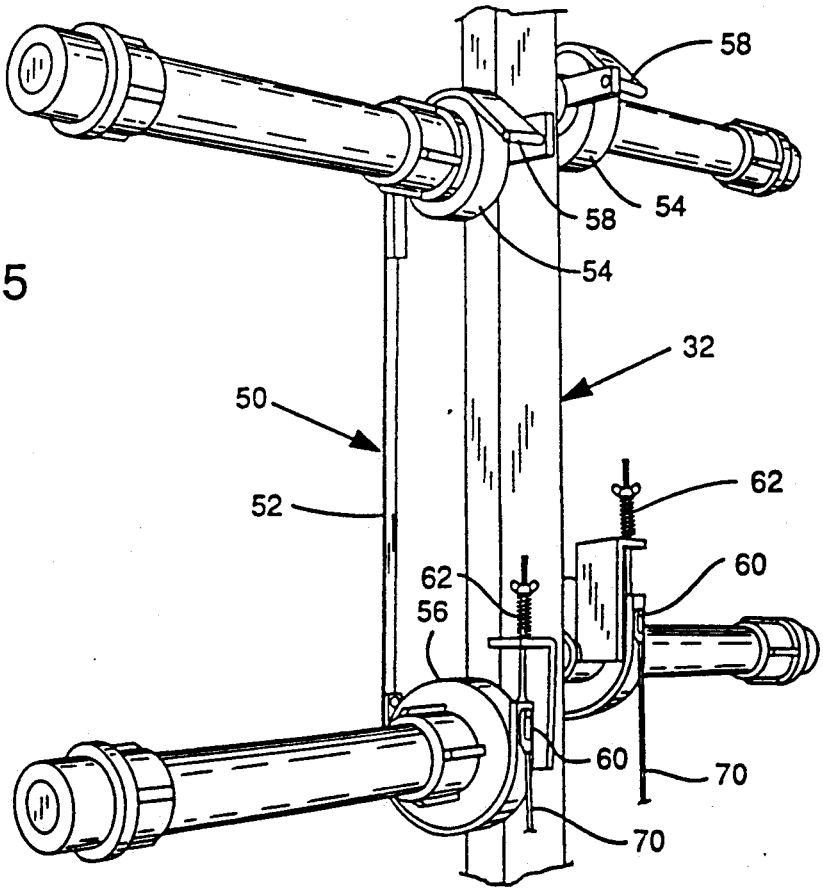
FIG. 15 is another view showing the brake band and the spindles in the tension control system of FIG. 4.

Referring now to FIGS. 4–16, a dispensing apparatus 30 with which the above splicing technique can be employed comprises a frame 32 on which are mounted two spools 24, 34 of tape. Tape is routed from one of these spools over a fixed roller 36 and down to a tensioning roller 38. Tensioning roller 38 is mounted on a block 40 that rides on slider rods 42. The block 40 is pulled downwardly by a spring 44 and upwardly by tension in the tape. (In the illustrated embodiment, the spring 44 is a rubber hose, as is visible in FIG. 12. In other embodiments, other mechanisms could of course be used, such as a hydraulic cylinder, etc.) The tape continues from tensioning roller 38 up over another fixed roller 46 and on into the corrugator equipment.

Figure 16:
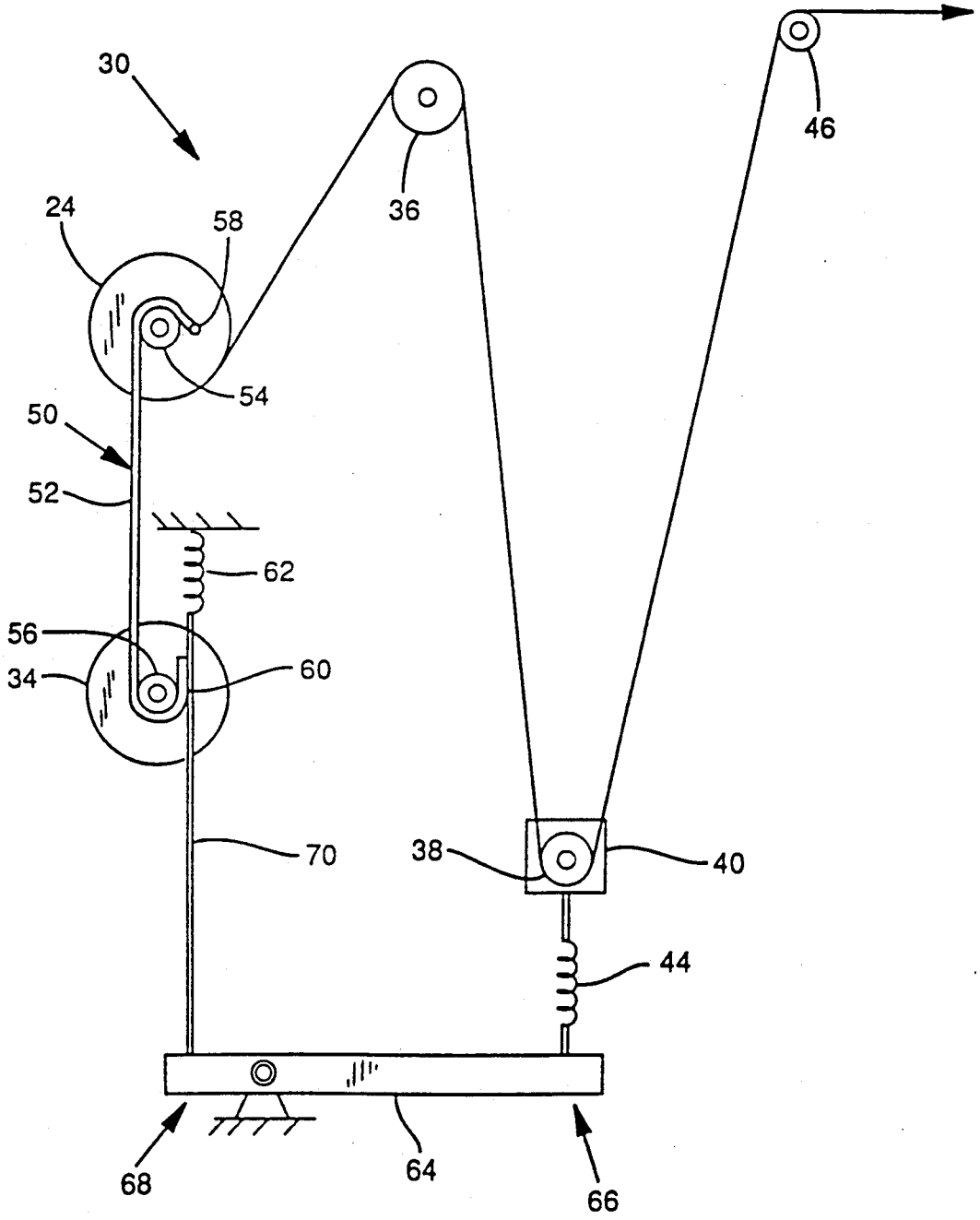
FIG. 16 is a schematic illustration of the tension control system of FIG. 4.

Referring now particularly to FIG. 16, it will be recognized that when the first spool 24 becomes depleted of tape, the above-described splicing technique will suddenly bring the second spool 34 (which had previously been stationary) into action. Since the second spool cannot immediately supply tape at the rate required by the corrugator (typically 600 feet per minute), the tension in the tape suddenly increases. The increased tension causes roller 38 to move upwardly against the force of spring 44. This movement serves to shorten the tape path, thereby providing tape to the corrugator without requiring the second spool to dispense a corresponding length contemporaneously.

After the second spool 34 accelerates to the required speed, the tension in the tape decreases. This permits the roller 38 to be pulled downwardly by spring 44. This movement, however, lengthens the tape path, momentarily pulling tape from the second spool at a rate greater than is required by the corrugator. This momentary oversupply of tape introduces slack into the system which diminishes the force pulling tape from spool 34, permitting it to slow down. When the slack is used up, the spool is no longer operating at the requisite speed and a tension spike occurs when the system again tries to draw tape from the spool faster than it is immediately able to supply it. This in turn causes the tensioning roller 38 to move upwardly against spring 44. The process repeats. The net result is a diminishing series of oscillations in the system, with the tape alternately going slack and too tight until equilibrium is finally established. During the slack intervals, the tape may become misoriented (i.e. wrong side down) or may even jump the rollers.

Another way of conceptualizing this oscillation phenomenon is that spring 44 absorbs energy applied by the corrugator when the second spool is started and stores it as spring tension. After the second spool accelerates to full operating speed, the spring releases that stored energy back to the system. This released energy is absorbed by the second spool and is stored in the form of a rotational speed higher than is required by the system. This generates an oversupply of free tape so that the pulling force exerted by the corrugator is no longer applied to the spool. The spool slows while the slack is taken up. When the slack is exhausted, the corrugator again exerts a tension spike against the spool (unless the spool is at exactly the speed required by the corrugator). This new tension spike again introduces energy into spring 44 and the cycle repeats.

To overcome this problem, the apparatus 30 is provided with a dynamic brake assembly 50. Brake assembly 50 comprises a brake band 52 which extends about portions of the spindles 54, 56 on which the spools 24, 34 ride and acts to retard their rotation. The upper end 58 of the brake band 52 is stationary, affixed to the frame 32. The lower end 60 is connected to a spring 62 which is connected at its other end to the frame 32. The spring 62 tensions the brake band 52 and establishes a quiescent braking force on spools 24 and 34. As discussed below, the apparatus is provided with means for changing this braking force in response to changes in tape tension.

When tape tension is low (i.e when the spool is providing tape faster than is required by the corrugator), it is desirable to apply an increased braking force to the spool to retard its dispensing of tape. Conversely, when the tape tension is high, it is desirable to apply a decreased braking force so that the dispensing of tape can be accelerated.

In the illustrated embodiment, one physical indicator of tape tension is the position of tensioning roller 38. When tape tension is high, the roller is elevated. When tape tension is low, the roller assumes a lower position. This motion is advantageously used in the present invention to control the braking force applied to the spools.

As shown in FIG. 16, a lever 64 is pivotally mounted on the frame 32 and extends under the tensioning roller 38 and the braking assembly 50. When tape tension is high, spring 44 pulls upwardly on a first end 66 of the lever, causing the second end 68 of the lever to move downwardly. This movement is coupled to the brake assembly 50 by a member 70 which pulls against brake spring 62, thereby reducing the tension in the brake band and causes a corresponding reduction in the braking force. Conversely, when the tape tension is lowered, the first end 66 of the lever moves downwardly, moving the second end upwardly. This motion permits brake spring 62 to reapply more tensioning force to the brake band 52, thereby causing a corresponding increase in the braking force.

From the foregoing, it will be recognized that the present invention employs a feedback mechanism that senses the tension in the tape and automatically adjusts the braking force in response thereto.

It will be noted that the brake band 52 extends 180 degrees about the lower spindle 56, but a lesser distance about the upper spindle 54. This reflects the fact that the weight of the brake band 52 hanging down from the upper spindle applies a tensioning force to the brake band on the upper spindle that is not present on the lower spindle. It is desirable that the braking forces applied to the two spindles be matched, although this is not a requirement of the invention.

FIGS. 4–6 and 12–15 show a tape dispensing apparatus that incorporates six of the assemblies shown in FIG. 16.

Having described and illustrated the principles of our invention with reference to a preferred embodiment, it will be apparent to those having skill in the art that the invention can be modified in arrangement and detail without departing from such principles. For example, while a braking assembly has been shown for quickly dampening undesirable oscillations in the system, in other embodiments, a variety of other techniques can be used to absorb the excess energy. In still other embodiments, the replacement spool is accelerated in response to electrical or mechanical sensors that indicate that the initial spool is about to be depleted.

In view of these and the wide range of other embodiments to which the concepts of the present invention can be applied, it should be recognized that the foregoing description is illustrative only and is not to be construed as limiting the scope of the invention. Instead, we claim as our invention all such modifications as may come within the scope and spirit of the following claims and equivalents thereof.

We claim:

1. In a method of dispensing reinforcing or tear tape in which rolls of tape are periodically exhausted as the dispensing is desired to continue, an improvement comprising the steps:

providing a roll of a first tape having attached to a trailing end thereof an obstacle extending thereacross;

providing a roll of a second tape having attached to a leading end thereof a string extending thereacross, said string having first and second ends;

dispensing tape from the first roll and while so doing, tying the two ends of the string together to form a closed loop around the first tape whereby the loop has a width narrower than the obstacle to prevent passage of the obstacle therethrough;

permitting the first roll of tape to be exhausted, whereby the loop tied around the first tape will catch the obstacle extending thereacross, thereby linking the trailing end of the first tape to the leading end of the second tape and causing tape to be dispensed from the second roll.

2. The method of claim 1 which further includes reducing the tension suddenly applied to tape on the second roll when tape begins being dispensed therefrom.

3. The method of claim 2 in which the reducing step includes rotationally accelerating the second roll before tape begins being dispensed therefrom.

4. The method of claim 2 in which the reducing step includes changing the length of a path traversed by the tape in response to increased tension therein.

5. A spool of reinforcing or tear tape, said tape having affixed to a leading end thereof a length of string with first and second ends, wherein said ends can be tied together to form a loop which may be used to link said leading end to the trailing end of another spool of tape.

6. The spool of tape of claim 5 in which the leading end of the tape is folded back over the string and adhered to itself, thereby securing the string to the leading end of the tape.

7. A spool of reinforcing or tear tape, said tape having affixed to a trailing end thereof an obstacle extending across and beyond the width of the tape, the trailing end of the tape being folded back over the obstacle to adhere to itself, thereby securing the obstacle to the trailing end of the tape.

* * * * *

UNITED STATES PATENT AND TRADEMARK OFFICE

CERTIFICATE OF CORRECTION

PATENT NO. : 5,029,768
APPLICATION NO. : 07/487651
DATED : July 9, 1991
INVENTOR(S) : Charles E. Asbury, Jr., Boris Boltak and Victor H. Clausen It is certified that error appears in the above-identified patent and that said Letters Patent is hereby corrected as shown below:

Please insert on Title page,
[*] Notice: This patent is subject to a terminal disclaimer.

Signed and Sealed this

Eighteenth Day of July, 2006

JON W. DUDAS
*Director of the United States Patent and Trademark Office*